US009024602B2

(12) United States Patent
Fort et al.

(10) Patent No.: US 9,024,602 B2
(45) Date of Patent: May 5, 2015

(54) REGULATOR WITH LOW DROPOUT VOLTAGE AND IMPROVED OUTPUT STAGE

(71) Applicant: STMicroelectronics (Rousset) SAS, Rousset (FR)

(72) Inventors: Jimmy Fort, Puyloubier (FR); Thierry Soude, Marseille (FR)

(73) Assignee: STMicroelectronics (Rousset) SAS, Rousset (FR)

( * ) Notice: Subject to any disclaimer, the term of this patent is extended or adjusted under 35 U.S.C. 154(b) by 191 days.

(21) Appl. No.: 13/848,403

(22) Filed: Mar. 21, 2013

(65) Prior Publication Data

US 2013/0257401 A1 Oct. 3, 2013

(30) Foreign Application Priority Data

Apr. 3, 2012 (FR) ..... 12 53037

(51) Int. Cl.
*G05F 1/575* (2006.01)
*G05F 1/46* (2006.01)

(52) U.S. Cl.
CPC . *G05F 1/575* (2013.01); *G05F 1/46* (2013.01)

(58) Field of Classification Search
CPC ..... H02M 1/46; H02M 1/56; H02M 1/575
USPC ..... 323/269, 273, 280
See application file for complete search history.

(56) References Cited

U.S. PATENT DOCUMENTS

| | | | | |
|---|---|---|---|---|
| 6,300,749 | B1 | 10/2001 | Castelli et al. | |
| 6,304,131 | B1 | 10/2001 | Huggins et al. | |
| 6,518,737 | B1 * | 2/2003 | Stanescu et al. | 323/280 |
| 6,788,146 | B2 * | 9/2004 | Forejt et al. | 330/257 |
| 7,612,547 | B2 * | 11/2009 | Renous | 323/280 |
| 8,471,538 | B2 * | 6/2013 | Pancholi et al. | 323/274 |
| 8,680,829 | B2 * | 3/2014 | Giroud | 323/280 |
| 2001/0030530 | A1 * | 10/2001 | Marty | 323/280 |
| 2003/0111986 | A1 | 6/2003 | Xi | |
| 2004/0051508 | A1 * | 3/2004 | Hamon et al. | 323/280 |
| 2006/0055383 | A1 * | 3/2006 | Eberlein | 323/280 |
| 2007/0159146 | A1 * | 7/2007 | Mandal | 323/280 |
| 2009/0009147 | A1 | 1/2009 | Jian | |
| 2011/0193540 | A1 * | 8/2011 | Dasgupta | 323/282 |
| 2013/0285631 | A1 * | 10/2013 | Bisson et al. | 323/280 |

FOREIGN PATENT DOCUMENTS

EP 1806640 7/2007

* cited by examiner

*Primary Examiner* — Fred E Finch, III
(74) *Attorney, Agent, or Firm* — Slater & Matsil, L.L.P.

(57) ABSTRACT

The regulator with low dropout voltage comprises an error amplifier and an output stage comprising an output transistor and a buffer circuit comprising an input connected to the output node of the error amplifier, an output connected to the output transistor, a follower amplifier connected between the input and the output of the buffer circuit. The buffer circuit furthermore comprises a transistor active load connected to the output of the follower amplifier and a negative feedback amplifier arranged in common gate configuration and connected between the output of the follower amplifier and the gate of the transistor of the active load.

24 Claims, 4 Drawing Sheets

REGULATOR WITH LOW DROPOUT VOLTAGE AND IMPROVED OUTPUT STAGE

This application claims priority to French Patent Application 1253037, which was filed Apr. 3, 2012 and is incorporated herein by reference.

TECHNICAL FIELD

The invention relates to regulators with a low voltage drop, commonly denoted by those skilled in the art under the acronym LDO (Low Drop Out Voltage) and, more particularly, to the buffer circuit situated in the output stage of such a regulator.

A regulator with a low voltage drop or low dropout voltage (difference between the voltage delivered at the output and the input voltage) allows a stable output voltage to be obtained regardless of the value of the output current demand

BACKGROUND

One widely used LDO regulator architecture comprises an error amplifier whose output node is connected to the gate of an output transistor, generally a PMOS power transistor, of the output stage. In order to decrease the capacitance on the output node of the error amplifier and thus decrease the charging or discharging time of the gate of the output transistor in the presence of high currents, a buffer circuit comprising a follower amplifier is inserted between the output node of the error amplifier and the gate of the output transistor.

However, the presence of such a buffer circuit adds an additional pole in the Bode diagram of the variations of the open-loop gain of the error amplifier as a function of the frequency of the signal. And the output pole of the regulator and this additional pole can then be situated at neighbouring frequencies, thus creating a complex conjugate pole which degrades the stability of the system.

BRIEF DESCRIPTION OF THE DRAWINGS

Other advantages and features of the invention will become apparent upon examining the detailed description of non-limiting embodiments, and the appended drawings in which.

DETAILED DESCRIPTION OF ILLUSTRATIVE EMBODIMENTS

Before addressing the illustrated embodiments in detail, various embodiments and advantageous features thereof will be discussed generally in the following paragraphs.

According to one embodiment, a buffer circuit structure is provided that allows the said additional pole to be shifted towards the high frequencies, typically of the order of several decades, so as to move it away from the output pole and thus improve the stability of the system, and to increase the closed-loop bandwidth of the regulator, in other words its speed of reaction.

According to one aspect, a regulator with low dropout voltage is provided, comprising an error amplifier and an output stage comprising an output transistor and a buffer circuit comprising an input connected to the output of the error amplifier, an output connected to the output transistor, and a follower amplifier connected between the input and the output of the buffer circuit.

According to a general feature of this aspect, the buffer circuit furthermore comprises a transistor active load connected to the output of the follower amplifier and a negative feedback amplifier arranged in a common gate configuration and connected between the output of the follower amplifier and the gate of the transistor of the active load.

The feedback loop of the negative feedback amplifier allows the impedance at the output of the buffer circuit to be reduced, and consequently, the frequency of the additional pole created by the buffer circuit to be significantly increased, and hence this additional pole to be moved away from the output pole.

According to one embodiment, the follower amplifier and the negative feedback amplifier are structurally nested with at least one transistor in common, which allows a particularly compact structure to be obtained.

The compactness may be further enhanced by the use of biasing means common to the follower amplifier and to the negative feedback amplifier.

It is also possible to add a current branch within the buffer circuit so as to be able to increase the bias current of the follower amplifier and of the negative feedback amplifier when the output current of the regulator increases.

Although it is possible to use any known structure of error amplifier, it is advantageous for the error amplifier to comprise a differential pair of input transistors, preferably PMOS transistors, and a circuit with a differential folded cascode structure connected to the output of the said differential pair. When a capacitor, known as a Miller compensation capacitor, is used for improving the stability of the system, this allows it to be connected between the output stage of the regulator and the cascode node situated on the output side of the error amplifier. The size of this capacitor is then reduced with respect to that of a Miller capacitor connected to the output node of the error amplifier.

According to another aspect, an integrated circuit is provided comprising a regulator such as defined hereinabove.

Figure 1:
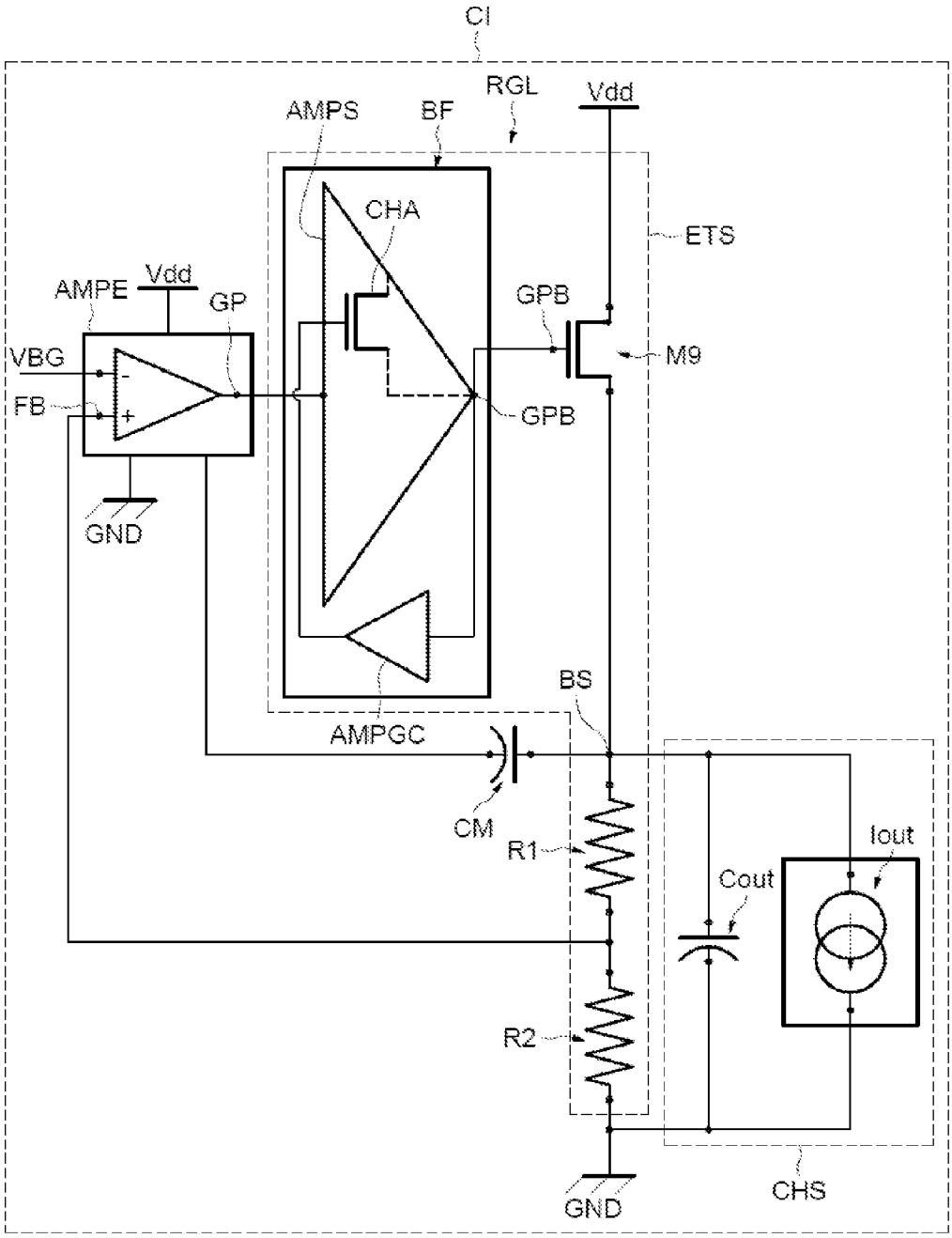
FIGS. 1 to 4 relate to various embodiments of a regulator according to the invention.

In FIG. 1, the reference RGL denotes a regulator with low dropout voltage, comprising an error amplifier AMPE connected between a power supply voltage Vdd and ground GND. This regulator is for example disposed within an integrated circuit CI.

The inverting input of the error amplifier AMPE is connected to a reference voltage VBG, which here is a bandgap voltage generated by a generator with a conventional structure known per se. This generator, not shown in this figure, may be disposed inside or outside of the regulator RGL.

The regulator RGL also comprises an output stage ETS connected to the output node GP of the error amplifier AMPE.

This output stage ETS here conventionally comprises a PMOS transistor M9 connected in series with a resistive circuit (voltage divider) R1, R2, between the power supply voltage Vdd and ground GND.

The gate of the transistor M9 (node GPB) is connected to the output node GP of the error amplifier AMPE by means of a buffer circuit BF, whereas the mid-point of the voltage divider R1, R2 is connected to the non-inverting input of the amplifier AMPE and delivers the voltage FB.

The drain of the transistor M9 forms the output terminal BS of the regulator RGL. This output terminal BS is connected to an output load CHS, here represented by a current source Tout and a capacitor Cout.

Although it is not indispensible, here a Miller compensation capacitor CM is connected between the output stage (and more particularly to the output terminal BS) and the error amplifier AMPE, for example to its output node GP or else, as will be seen in more detail hereinafter in one particular example of a structure, to the cascode node situated on the output side of the error amplifier.

The buffer circuit BF comprises a follower amplifier AMPS (gain equal to 1) connected between the input (node GP) and the output (node GPB) of the buffer circuit. A transistor active load CHA is connected to the output of the follower amplifier AMPS and the buffer circuit BF furthermore comprises a negative feedback amplifier AMPGC arranged in common gate configuration and connected between the output (node GPB) of the follower amplifier AMPS and the gate of the transistor of the active load CHA.

Figure 2:
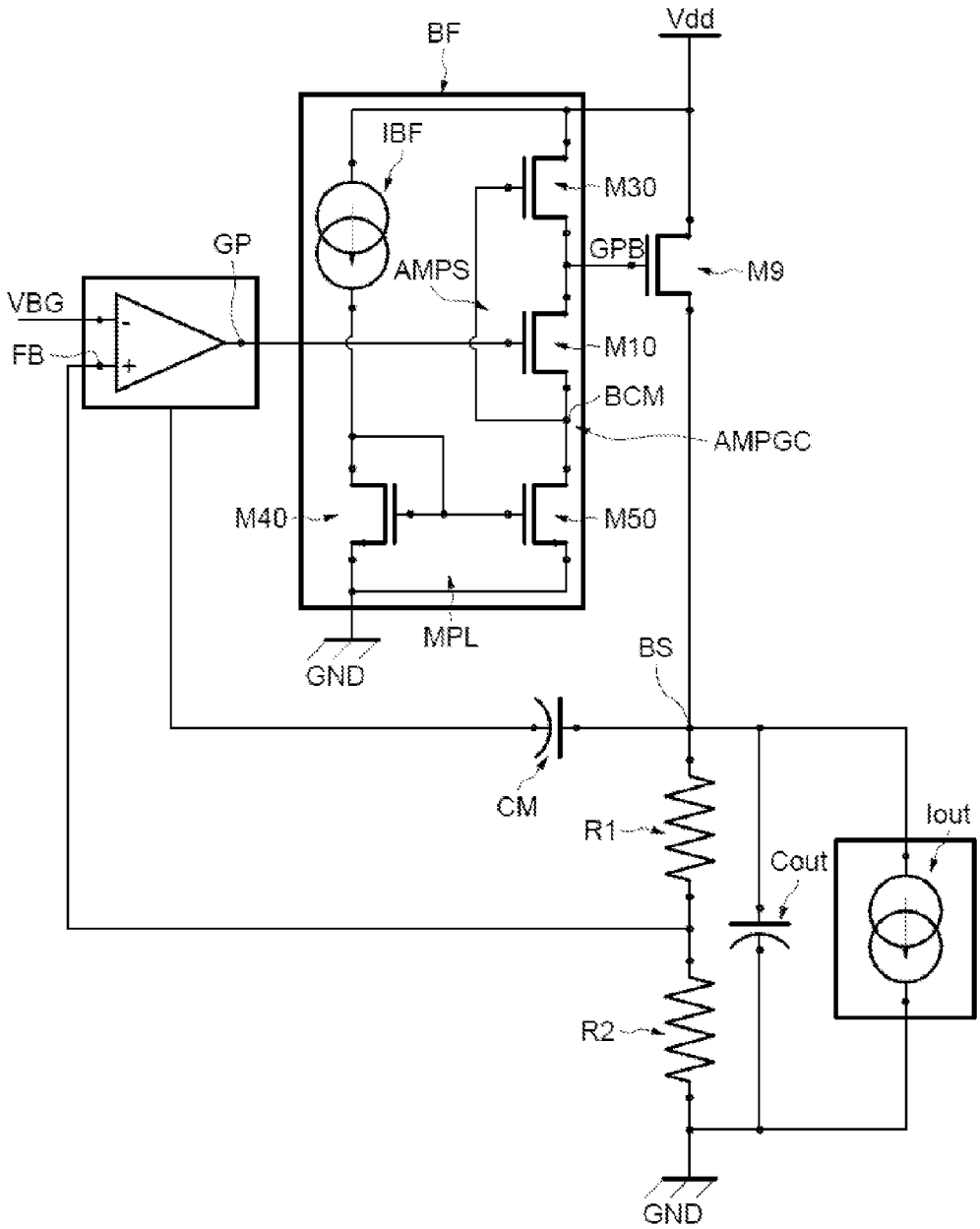

Reference will now more particularly be made to FIG. 2 which illustrates a first embodiment of a buffer circuit BF.

The follower amplifier AMPS comprises a follower transistor M10, here a PMOS transistor, connected between the input and the output of the buffer circuit. More precisely, the gate of the transistor M10 is connected to the input of the buffer circuit (node GP) and the source of this transistor M10 is connected to the output of the buffer circuit (node GPB).

A transistor M30, here also a PMOS transistor, connected between the power supply voltage Vdd and the source of the transistor M10, forms the active load of the follower transistor M10.

The buffer circuit also comprises means MPL for biasing the follower amplifier. These biasing means MPL here comprise a current source IBF, with a conventional structure known per se, connected to a current mirror comprising the NMOS transistors M40 and M50.

The negative feedback amplifier AMPGC here comprises the said follower transistor M10 and the biasing transistor M50 of the biasing means MPL, which is connected between the follower transistor M10 and ground GND.

The input of the amplifier AMPGC is formed by the output (node GPB) of the follower amplifier AMPS and the common terminal BCM between the follower transistor M10 and the biasing transistor M50 which forms the output of the negative feedback amplifier. This common terminal is connected to the gate of the active load transistor M30.

It can therefore be seen that the negative feedback amplifier AMPGC is arranged in common gate configuration and that the biasing means MPL are common to the follower amplifier and to the negative feedback amplifier.

Owing to the presence of this negative feedback amplifier AMPGC, the value of the resistance of the node GPB is decreased, with respect to the value of this resistance in the case of a buffer circuit not comprising a negative feedback amplifier, by a factor equal to the product of the transconductance of the transistor M30 and of the drain-source resistances of the transistors M10 and M50.

The frequency of the additional pole created by the buffer circuit is increased as a consequence, typically by several decades.

Figure 3:
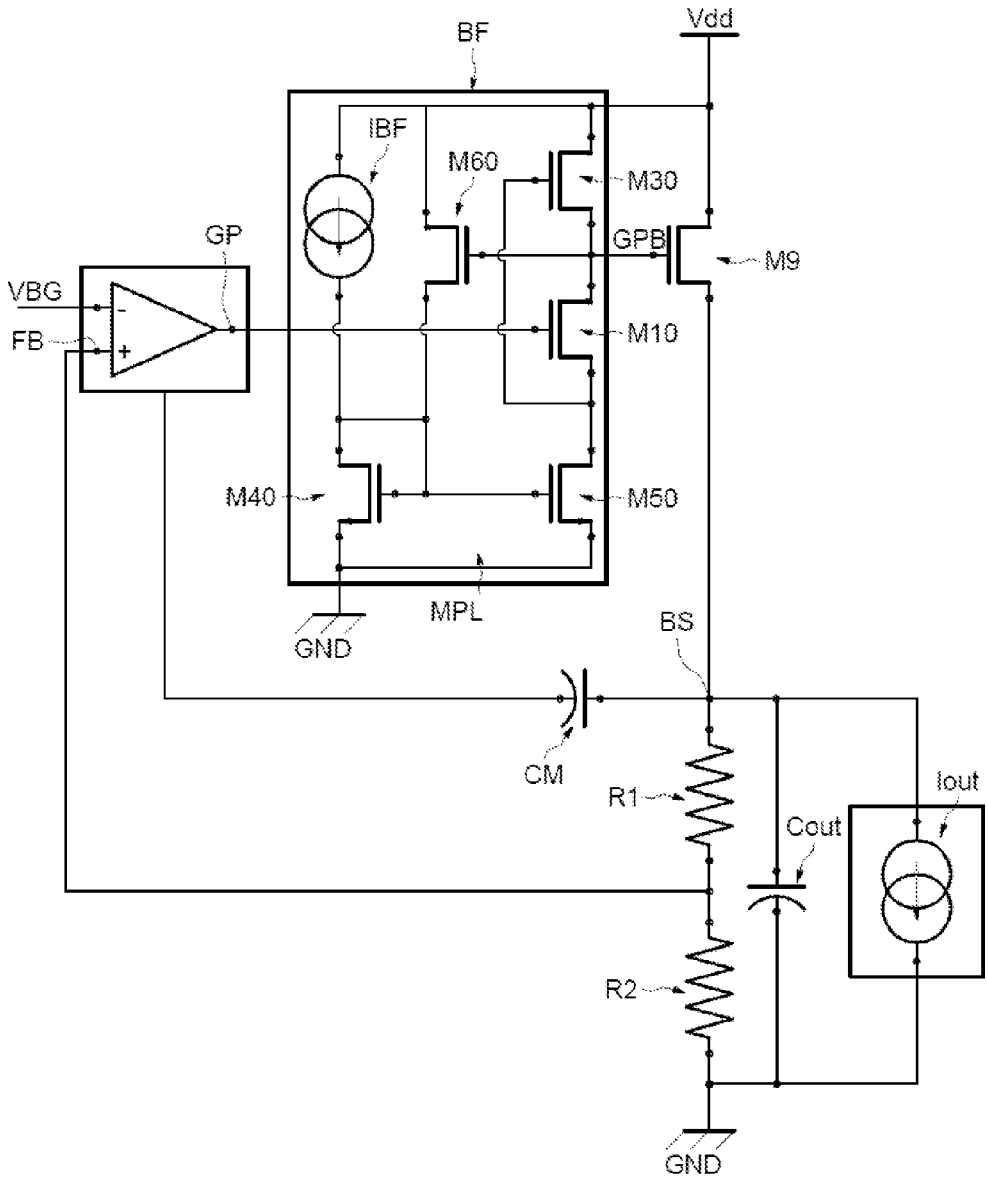

FIG. 3 illustrates another embodiment of a buffer circuit BF allowing the bias current of the follower amplifier and of the negative feedback amplifier to be increased when the output current of the regulator increases.

More precisely, the buffer circuit BF here additionally comprises auxiliary means configured for increasing the bias current of the follower amplifier AMPS and of the negative feedback amplifier AMPGC by a fraction of the output current delivered by the output transistor M9.

The said auxiliary means comprise an additional current branch comprising an auxiliary PMOS transistor M60 connected to the said power supply terminal Vdd in parallel with the current source IBF, the gate of the auxiliary transistor M60 and the gate of the output transistor M9 being connected together.

When the output current delivered by the output transistor M9 increases, the voltage at the node GPB decreases and the bias current of the follower amplifier should then be increased. The auxiliary transistor M60 thus allows a fraction of the output current to be re-injected into the current mirror M40, M50.

Furthermore, the transconductances of the transistors M10 and M30 also increase which allows an additional high frequency pole to be conserved even in the presence of high output currents. An excellent stability at high current is therefore obtained. The charging and discharging time of the gate capacitance of the transistor M9 is also decreased which allows its 'slew rate' (a term known to those skilled in the art) to be improved.

Figure 4:
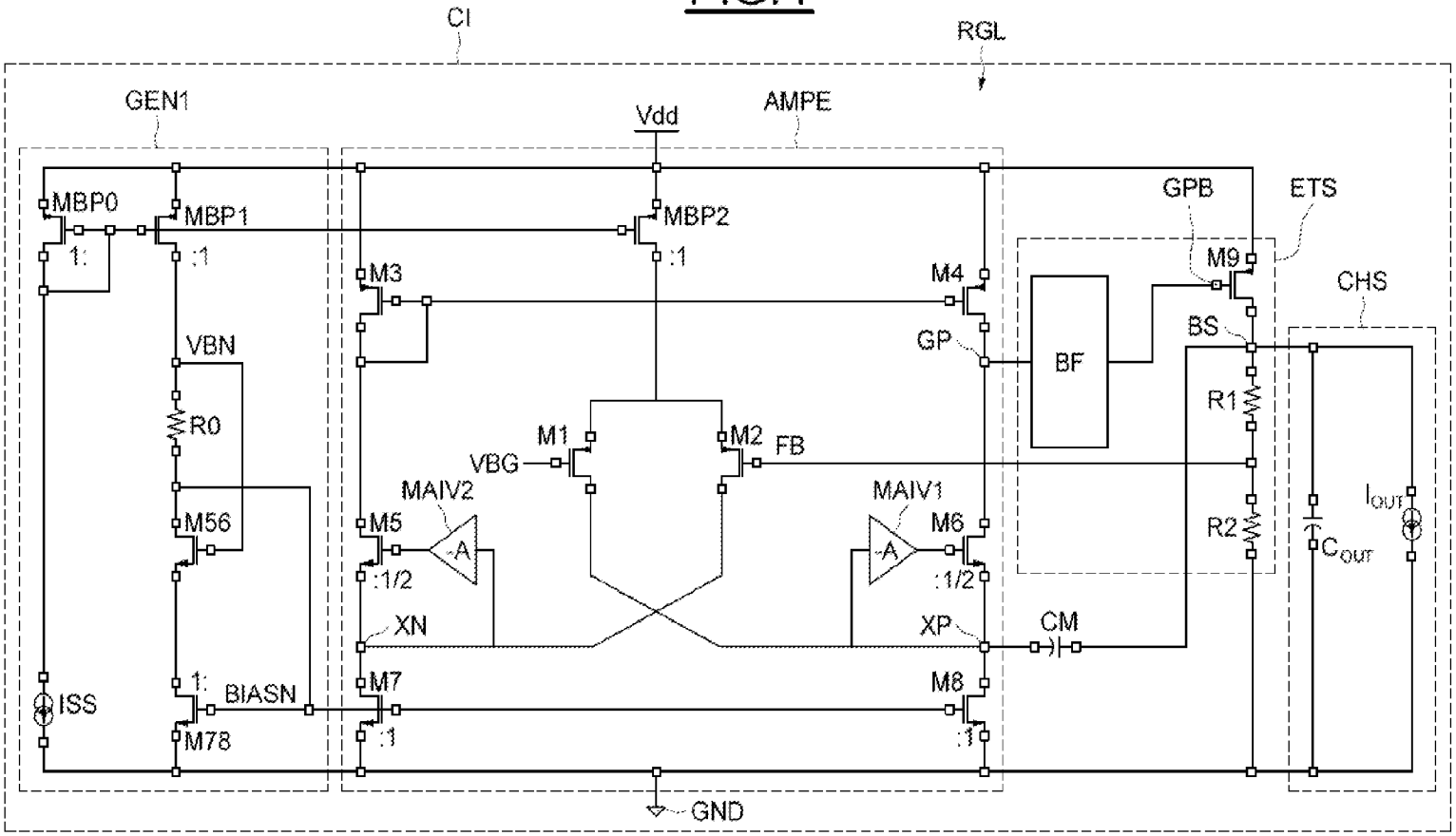

Reference is now more particularly made to FIG. 4 which illustrates one particular embodiment of an error amplifier AMPE.

In this exemplary embodiment, the error amplifier AMPE comprises a differential pair of input transistors M1, M2, here PMOS transistors (although it is also possible to employ NMOS transistors).

The use of PMOS transistors notably allows a very low input common mode voltage to be obtained.

Another advantage of the use of PMOS transistors in the differential pair of the error amplifier resides in the fact that it becomes possible for the voltage at the node GP to be close to the power supply voltage Vdd. This then allows the PMOS transistor M9 to be set in its OFF state when the output load has no current demand.

The gate of the transistor M1, which forms one of the inputs of the differential pair, is connected to the reference voltage VBG.

The gate of the transistor M2 forms the other input of the differential pair, which receives the voltage FB.

The error amplifier AMPE also comprises a circuit with a differential folded cascode structure, connected to the differential output XN, XP of the differential pair. This cascode circuit comprises a biasing stage comprising the biasing transistors M7 and M8, cascoded by a stage with cascode transistors M5, M6.

The nodes XN and XP form the two input cascode nodes of the cascode circuit. A folded cascode structure is referred to here because the transistors of the cascode circuit are transistors of a type different from those of the differential pair. In other words, since the differential pair here comprises PMOS transistors, the transistors of the cascode circuit are NMOS transistors.

The error amplifier AMPE also comprises a current mirror formed by the transistors M3 and M4, allowing the amplifier AMPE to have a single output node GP formed by the drain of the PMOS transistor M4.

The biasing of the differential pair M1 and M2 is provided by a PMOS transistor MBP2 connected between the power supply voltage Vdd and the sources of the transistors M1 and M2 of the differential pair.

The bias voltages of the differential pair M1 and M2 and of the cascode circuit are obtained by a reference voltage generator GEN1, here comprising a current source ISS connected via a current mirror MBP0, MBP1 to a resistance RO connected in series between the transistor MBP1 and ground, with an NMOS transistor M56 and an NMOS transistor M78.

The gate of the transistor MBP1 is connected to the gate of the transistor MBP2. A voltage VBN, available at the drain of the PMOS transistor MBP1, is also available on the gate of the transistor M56.

The common node between the resistance RO and the drain of the transistor NMOS M56 is connected to the gate of the transistor M78 and also to the gate of the transistors M7 and M8.

Thus, a voltage BIASN is available at these gates. Consequently, a voltage difference exists between the two reference voltages VBN and BIASN. This voltage difference is of course chosen to be higher than the drain-source voltage VDS of a transistor in saturation mode, so as to allow the correct operation of the regulator. A voltage difference equal to at least 100 mV could for example be chosen.

The generator GEN1 is here only one exemplary embodiment of a circuit delivering reference voltages VBN and BIASN. Of course, any known structure allowing reference voltages to be generated is suitable.

The Miller compensation capacitor CM is connected between the output stage (and more particularly to the output terminal BS) and the cascode node XP, which is the cascode node situated on the output side of the error amplifier. This allows a smaller Miller capacitor to be used than if it were directly connected to the output node GP of an error amplifier lacking a folded cascode structure.

Although it is not indispensible, it is advantageous to combine a buffer circuit BF, such as that which has just been described, with a structure of error amplifier AMPE additionally comprising an inverter amplifier module MAIV1 in a feedback loop between the cascode node XP and the gate of the cascode transistor M6 which is connected between the cascode node XP and the output node GP of the error amplifier. Such an error amplifier structure is described in the French Patent Application No. 1252322 in the name of the Applicant.

Indeed, such a structure with a feedback amplifier module allows the impedance to be reduced at the cascode node XP connected to the capacitor CM (the impedance at the node XP is divided by the gain A of the inverter amplifier module MAIV1), and hence push the pole present at this node towards the high frequencies so as to move it away from the pole present at the output BS of the regulator, which again goes in the direction of a better stability of the system.

Although it is sufficient to only provide a single amplifier module MAIV1 connected between the node XP and the cascode transistor M6, it is preferable, notably for reasons of matching and of symmetry of the structure, to also provide a second inverter amplifier module MAIV2 in a feedback loop between the other cascode node XN and the other cascode transistor M5.

Several implementations are possible for the inverter amplifier module or modules MAIV. It is notably possible to provide two inverter amplifier modules with a voltage input or with a current input or even a single inverter amplifier module with a differential input/differential output with a common-mode voltage control loop.

What is claimed is:

1. A regulator with low dropout voltage, comprising an error amplifier and an output stage comprising:

an output transistor configured to be connected to a load; and a buffer circuit comprising:

an input connected to an output node of the error amplifier, an output connected to the output transistor, a follower amplifier connected between the input and the output of the buffer circuit, an active load transistor having a conduction path connected between a power supply terminal and the output; and a negative feedback amplifier arranged in common gate configuration and connected between an output of the follower amplifier and a gate of the active load transistor.

2. The regulator according to claim 1, wherein the buffer circuit comprises a biasing circuit common to the follower amplifier and to the negative feedback amplifier, and wherein the follower amplifier comprises a follower transistor connected between the input and the output of the buffer circuit; and the negative feedback amplifier comprises the follower transistor and a biasing transistor of the biasing circuit, a common terminal between the follower transistor and the biasing transistor forming the output of the negative feedback amplifier.

3. The regulator according to claim 2, wherein the buffer circuit furthermore comprises an auxiliary circuit configured for increasing a bias current of the follower amplifier and of the negative feedback amplifier by a fraction of an output current delivered by the output transistor.

4. The regulator according to claim 3, wherein the biasing circuit of the follower amplifier and of the negative feedback amplifier comprise a current source, the output transistor is a PMOS transistor connected between the power supply terminal and an output terminal of the regulator and the auxiliary circuit comprises an auxiliary PMOS transistor connected to the power supply terminal in parallel with the current source, a gate of the auxiliary PMOS transistor and a gate of the output transistor being connected together.

5. The regulator according to claim 1, wherein the error amplifier comprises a differential pair of input transistors and a cascode circuit with a differential folded cascode structure connected to an output of the differential pair of input transistors, and a capacitor connected between the output stage and a cascode node of the cascode circuit, coupled to the output node of the error amplifier.

6. The regulator according to claim 5, wherein the error amplifier furthermore comprises at least one inverter amplifier module in a feedback loop between the cascode node and a gate of a cascode transistor of the cascode circuit connected between the cascode node and the output of the error amplifier.

7. The regulator according to claim 5, wherein the differential pair of input transistors are PMOS transistors.

8. An integrated circuit, comprising:

a power supply terminal;

a ground terminal;

a regulator connected between the power supply terminal and the ground terminal and including:

an error amplifier and an output stage comprising:

an output transistor configured to be connected to a load; and a buffer circuit comprising:

an input connected to an output node of the error amplifier, an output connected to the output transistor, a follower amplifier connected between the input and the output of the buffer circuit, an active load transistor having a conduction path connected between the power supply terminal and the output, and a negative feedback amplifier arranged in common gate configuration and connected between an output of the follower amplifier and a gate of the active load transistor; and a load coupled to an output of the regulator.

9. The integrated circuit according to claim 8 wherein the load includes a capacitive element.

10. The integrated circuit according to claim 8, wherein the buffer circuit comprises a biasing circuit coupled to the follower amplifier and coupled to the negative feedback amplifier, and wherein the follower amplifier comprises a follower transistor connected between the input and the output of the buffer circuit; and the negative feedback amplifier comprises the follower transistor and a biasing transistor of the biasing circuit, a common terminal between the follower transistor and the biasing transistor forming the output of the negative feedback amplifier.

11. The integrated circuit according to claim 10, wherein the buffer circuit furthermore comprises an auxiliary circuit configured to increase a bias current of the follower amplifier and of the negative feedback amplifier by a fraction of an output current delivered by the output transistor.

12. The integrated circuit according to claim 11, wherein the biasing circuit of the follower amplifier and of the negative feedback amplifier includes a current source, the output transistor is a PMOS transistor connected between the power supply terminal and the output of the regulator, and the auxiliary circuit includes an auxiliary PMOS transistor connected to the power supply terminal in parallel with the current source, a gate of the auxiliary PMOS transistor and a gate of the output transistor being connected together.

13. The integrated circuit according to claim 8, wherein the error amplifier comprises a differential pair of input transistors and a cascode circuit with a differential folded cascode structure connected to an output of the differential pair, and a capacitor connected between the output stage and a cascode node of the cascode circuit, coupled to the output node of the error amplifier.

14. A regulator circuit comprising:

an error amplifier having a first output;

a buffer circuit having a first input connected to the first output and having a second output;

an output stage having a second input connected to the second output and having a third output configured to be coupled to a load; and wherein the buffer circuit includes:

a follower amplifier coupling the first input and the second output, an active load transistor having a conduction path connected between a power supply terminal and the second output and having a gate terminal, and a common gate mode negative feedback amplifier connected between the second output and the gate terminal.

15. The regulator circuit of claim 14 further comprising a voltage divider circuit connected to the third output, the voltage divider circuit having an intermediate node.

16. The regulator circuit of claim 15 wherein the error amplifier has a first input connected to the intermediate node and a second input connected to a reference voltage.

17. The regulator of claim 16 wherein the error amplifier comprises a differential pair of PMOS input transistors, a first one of the pair having a gate connected to the intermediate node and a second one of the pair having a gate connected to the reference voltage.

18. The regulator of claim 14 wherein the error amplifier comprises a differential pair of input transistors and a cascode circuit with a differential folded cascode structure connected to an output of the differential pair.

19. The regulator of claim 18 further comprising a capacitor connected between the third output and a cascode node of the cascode circuit.

20. The regulator of claim 14 further comprising a capacitive load connected to the third output.

21. A regulator circuit comprising:

an error amplifier having an error output;

an output stage having a control input and having a load output; and a buffer circuit having a first input coupled to the error output and having a first output coupled to the control input, wherein the buffer circuit comprises:

an active load transistor having a conduction path coupled between a power supply terminal and the first output and having a control terminal, a follower transistor having a conduction path coupled between the first output and a negative feedback node and having a control terminal coupled to the first input, wherein the negative feedback node is coupled to the control terminal of the active load transistor, a biasing current source having a first conduction terminal coupled to the power supply terminal and having a second conduction terminal, and a current mirror having a first branch with a conduction path coupled between the negative feedback node and a reference supply terminal and having a second branch with a conduction path coupled between the second conduction terminal of the biasing current source and the reference supply terminal.

22. The regulator circuit of claim 21, wherein the buffer circuit further comprises an auxiliary transistor having a conduction path coupled between the power supply terminal and the second conduction terminal and having a control terminal coupled to the first output.

23. The regulator circuit of claim 21, further comprising a voltage divider circuit connected to the load output, the voltage divider circuit having an intermediate node, wherein the error amplifier has a first input connected to the intermediate node and a second input connected to a reference voltage.

24. The regulator of claim 21, wherein the error amplifier comprises a differential pair of input transistors and a cascode circuit with a differential folded cascode structure connected to an output of the differential pair.

* * * * *